US007344458B2

(12) United States Patent
Connerley et al.

(10) Patent No.: US 7,344,458 B2
(45) Date of Patent: Mar. 18, 2008

(54) OVERHEAD-SUPPORTED NET SYSTEM

(75) Inventors: James J. Connerley, Noblesville, IN (US); Andrew T. Snow, Fishers, IN (US)

(73) Assignee: Gared Holdings, LLC, Noblesville, IN (US)

( * ) Notice: Subject to any disclaimer, the term of this patent is extended or adjusted under 35 U.S.C. 154(b) by 145 days.

(21) Appl. No.: 11/353,788

(22) Filed: Feb. 14, 2006

(65) Prior Publication Data

US 2007/0191152 A1 Aug. 16, 2007

(51) Int. Cl.
*A63B 71/00* (2006.01)

(52) U.S. Cl. ..... 473/494; 473/490

(58) Field of Classification Search ..... 473/490, 473/494, 473

See application file for complete search history.

(56) References Cited

U.S. PATENT DOCUMENTS

| | | | | | |
|---|---|---|---|---|---|
| 1,778,173 | A | * | 10/1930 | Steele | 473/482 |
| 2,961,236 | A | * | 11/1960 | Murphy | 473/482 |
| 3,065,964 | A | | 11/1962 | Barnes | |
| 3,561,759 | A | * | 2/1971 | Duganich | 473/482 |
| 4,153,247 | A | | 5/1979 | Burns | |
| 4,253,671 | A | | 3/1981 | Pace | |
| 4,968,042 | A | | 11/1990 | Stewart | |
| 4,973,059 | A | | 11/1990 | Stewart | |
| 5,215,310 | A | | 6/1993 | Allbright | |
| 5,393,069 | A | | 2/1995 | Taylor | |
| 5,651,552 | A | | 7/1997 | Whelchel | |
| 6,461,258 | B1 | | 10/2002 | Vacanti | |
| 6,511,391 | B2 | | 1/2003 | Schroeder | |
| 6,776,733 | B2 | | 8/2004 | Schroeder | |
| 6,830,522 | B1 | | 12/2004 | Chen | |
| 2001/0002377 | A1 | * | 5/2001 | Schroeder | 473/473 |

FOREIGN PATENT DOCUMENTS

| | | |
|---|---|---|
| SU | 1535549 A1 | 1/1990 |

* cited by examiner

*Primary Examiner*—Raleigh W. Chiu
(74) *Attorney, Agent, or Firm*—Brinks Hofer Gilson & Lione

(57) ABSTRACT

A net system pivotally displacing a net between a playing position in a vertical plane bifurcating a playing area and a nearly horizontal elevated storage position freeing the playing area for other uses. Parallel poles are located on opposite sides of the playing area with a net coupled to the pair of poles to lie in a plane including the pair of poles. Coupling members couple pivot members to ceiling structure over the playing area. Supports have proximal ends fixed to an upper end of each of the pair of poles and a distal end extending on a common side of the plane defined by the net and poles. The distal end of the supports are coupled to the pivot members to allow the poles and net to be pivoted about an axis lying parallel to but outside the plane defined by the net and poles, the position of the pivot members ensuring a downward force on the playing surface by lower ends of the poles when the poles are in the vertical playing position.

20 Claims, 5 Drawing Sheets

OVERHEAD-SUPPORTED NET SYSTEM

BACKGROUND OF THE INVENTION

The present invention relates to net systems, consisting generally of a net suspended between a spaced pair of poles and supports for the poles. The present invention relates particularly to such a net system that is supported from a ceiling or roof structure and can be moved between a vertical playing position within a playing area and an elevated storage position that frees the playing area for other uses.

The net system of the present invention can be used in connection with the sports of volleyball, tennis and badminton, as well as other sports played with a vertical net bifurcating the playing area, which can be within a gymnasium or other sports facility. Often the sports facility is a multi-use facility in which other sports can be played that do not require such a vertical net bifurcating the playing area. It is therefore desirable that the net be easily and quickly located at a desired playing position within the facility, and just as easily and quickly moved to a storage position.

U.S. Pat. No. 3,065,964 discloses a game net supporting system that includes a cantilevered post structure mounted to the wall of an indoor gymnasium that can be folded against the wall out of the way when not in use. However, the structural details of the system are such that the erection and disassembly of the game net support is rather complicated and may require more than two people to safely accomplish.

U.S. Pat. No. 4,153,247 discloses game net supporting mounting posts that are movable between a storage position and a playing position with the aid of a truck or dolly. The purpose of the truck is to hold the mounting post in a nearly upright position during assembly without the aid of a co-worker. The truck is attached to the post so that the truck causes the mounting post to tilt away from the game net during preliminary assembly. This helps to support the net's weight during assembling stages prior to final tightening of the assembly. As the tensioning means pulls the net tight the mounting post is pulled to a full upright position and the rear end of the truck tends to be lifted from the gymnasium floor. When the net is loosened the rear end of the truck returns to the floor. But each mounting post must be separately handled, so although installation by a single person is possible, the installation is time consuming.

U.S. Pat. No. 6,776,733 discloses an overhead supported net system including a net and a spaced pair of masts pivotally connected to an overhead structure to pivot about an axis parallel to the longitudinal axis of the net between a stored position and a play position. Braces are connected to the overhead structure and the masts to lock the masts in the play position. Cables are connected to the masts and a driver to move the masts between the stored and play positions. The braces each include a pair of members hinged to each other at one end and connected to either the mast or the overhead structure at their other end. A latch is provided at the hinge to lock the pair of members and the mast in the play position. The braces are pivotally connected to the overhead structure and the mast. The masts and the ladder terminate short of the floor in the play position. The masts include fixed diagonal members that provide the necessary strength to resist inward deflection of the masts when the net is placed under the required tension for play. A height adjustment mechanism including a screw drive is provided connecting the net to the mast. In one embodiment, the bottom of the mast terminates adjacent the bottom edge of the net.

U.S.S.R. Inventor's Certificate No. SU 1535549 discloses a volleyball system that includes a pair of posts having upper ends hinged to frames fixed to the ceiling of a building. The axes of the hinges are situated in the plane of the net and form an oblique angle between themselves. Holders for the posts are mounted on the frames in the non-playing (upper) position. To secure the posts in the playing position, there are sockets in the floor of the building. There is a threaded rod on the lower end of each post that fits into the corresponding socket in the floor to secure the posts in the playing position.

Despite the various features and benefits of the structures of the forgoing disclosures, there remains a need for a net system that can be easily moved between the non-playing position and the playing position by one person, but requires no sockets or other attachments to the playing surface so that when the net is in the non-playing position, the playing surface is free from obstruction, yet when in the playing position is firmly supported by the playing surface.

SUMMARY OF THE INVENTION

These several needs are satisfied by a net system having a pair of parallel poles vertically positionable on opposite sides of a playing area with a net coupled to the pair of poles to lie in a plane including the pair of poles. Supports are fixed to an upper end of each of the pair of poles including pivot members positioned to one side of the plane containing the net and pair of poles. Coupling members couple the pivot members to the ceiling structure covering the playing area. The pivot members allow the poles and net to be pivotally displaced from a nearly horizontal non-playing storage position above a playing surface on one side of the playing area to a vertical playing position in a vertical plane bifurcating the playing area. The position of the pivot members to one side of the plane containing the net and poles ensures a downward force on the playing surface by lower ends of the poles when the poles are in the vertical playing position.

The supports fixed to the upper end of each of the pair of poles can include a first support member having a first end fixed to the upper end of the pole, the first support member extending perpendicular to the plane defined by the net and poles. A second support member can be fixed to a second end of the first support member. The second support member can be perpendicular to the first support member in a plane parallel to the playing surface. A third support member can extend obliquely from a point on the second support member spaced from the second end of the first support member to a point on the pole below the upper end of the pole and above the net. The pivot members can be coupled to the second member adjacent opposite ends of the second member. The pivot members can be on upward extensions fixed to the second member.

Net support members can be coupled to each of the poles and to the net, with the net support members being movable with respect to the poles so that the net can be situated at any selected position between a tennis position with the lower margin of the net adjacent to the playing surface upward to a men's volleyball position. This vertical movability of the net with respect to the poles allows the same facility to be used for a wide variety of sports requiring a net bifurcating a playing area. The pivotal arrangement of the net and poles allow the playing area to be used for even other activities that do not require the presence of a net bifurcating the playing area.

Deployment of the net system can be accomplished by providing a pair of parallel poles vertically positionable on opposite sides of a playing area having a net coupled to the pair of poles to lie in a plane including the pair of poles with supports fixed to an upper end of each of the pair of poles including pivot members positioned on one side of the plane; coupling the pivot members at selected points of a ceiling structure covering the playing area to allow the poles and net to be pivotally displaced from a storage position above the playing surface on one side of the playing area to a vertical playing position in a vertical plane bifurcating the playing area; and adjusting the position of members on the lower end of each of the pair of poles to ensuring a downward force on the playing surface by the lower ends of the poles when the poles are in the vertical playing position. A further vertical adjustment of the net relative to the pair of poles can accommodate the particular standards of a selected sport to be played with the net at a playing position in a vertical plane bifurcating a playing area.

One feature of the present invention is the defined floor positioning for the poles supporting the net without any sockets or clips in the floor. This feature has the advantage of allowing full use of the playing area when the net and poles are moved to the storage position, which is something not permitted if sockets or clips are required to be installed in the floor. Another feature is the ease with which the system is deployed from the storage position to the playing position, so that a single person can easily and quickly deploy the net support system in position ready for play.

Other features of the present invention and the corresponding advantages of those features will be come apparent from the following discussion of the preferred embodiments of the present invention, exemplifying the best mode of practicing the present invention, which is illustrated in the accompanying drawings. The components in the figures are not necessarily to scale, emphasis instead being placed upon illustrating the principles of the invention. Moreover, in the figures, like referenced numerals designate corresponding parts throughout the different views.

DESCRIPTION OF PREFERRED EMBODIMENTS

Figure 1:
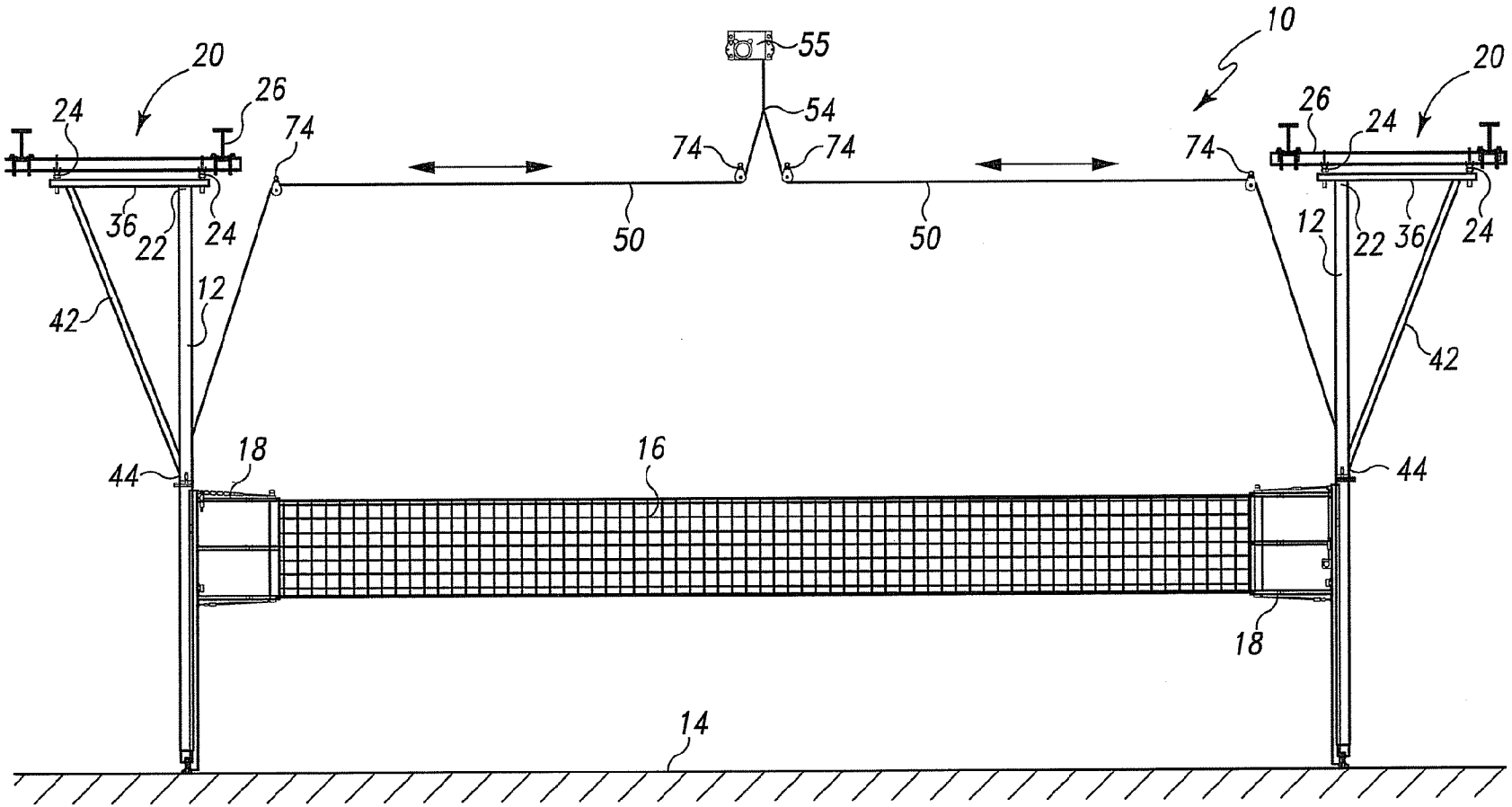
FIG. 1 is a front elevation view of a net system of the present invention when situated in a vertical playing position.

A net system 10 of the present invention is shown in FIG. 1 to have a pair of parallel poles 12 that are vertically positionable on opposite sides of a playing area 14 with a net 16 coupled to the pair of poles 12. The net 16 can be connected to the poles 12 with tension members 18 that can be adjusted to achieve the desired amount of tension in the net 16. Details of a preferred connection between the poles 12 and the net 16 are discussed below in connection with FIGS. 6 and 9.

Figure 3:
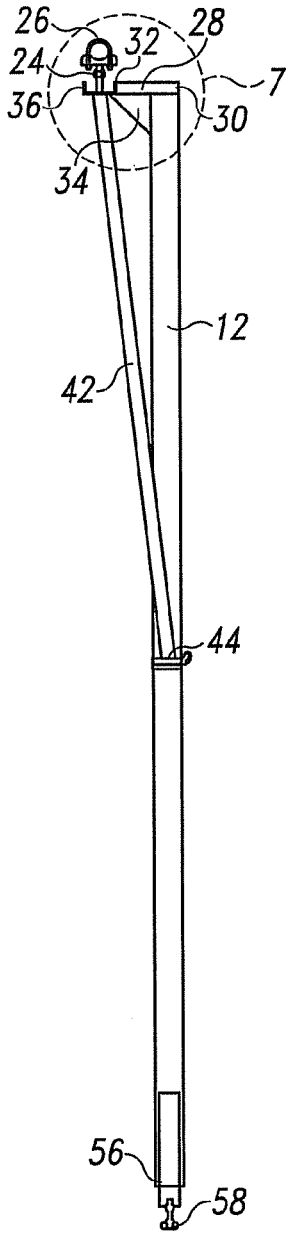
FIG. 3 is a side elevation of a single mast used in the net system of the present invention.
Figure 4:
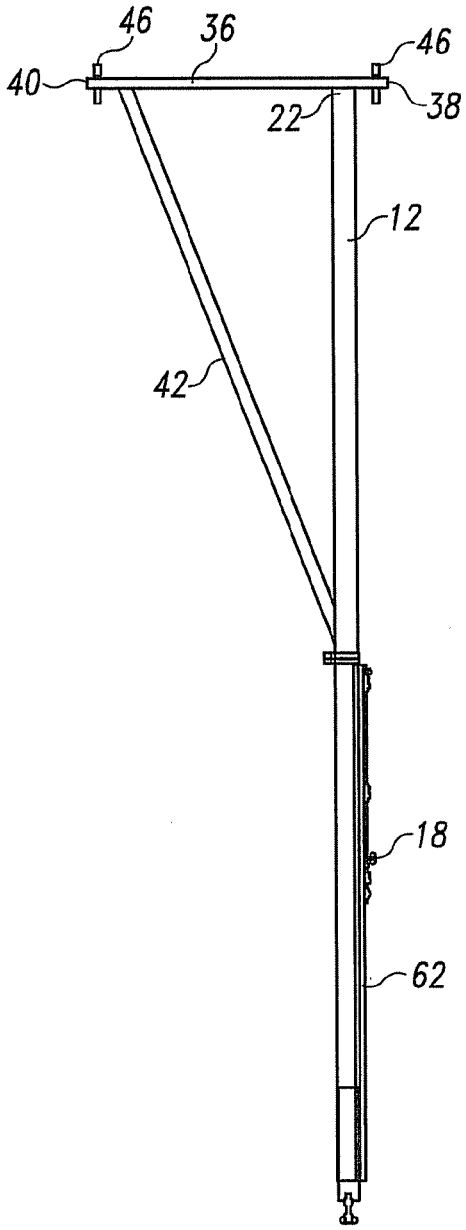
FIG. 4 is a front elevation view of a single mast used in the net system of the present invention.
Figure 5:
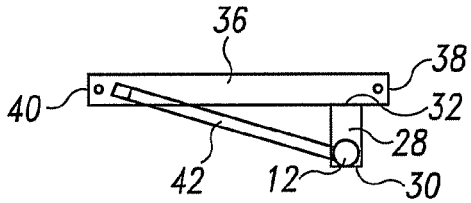
FIG. 5 is a top plan view of the single mast shown in FIG. 4.

Supports 20 are fixed to an upper end 22 of each of the pair of poles 12. The supports 20 include pivot members 24. Coupling members 26 couple the pivot members 24 to the ceiling structure covering the playing area 14. The supports 20 are shown in FIGS. 3-5 to include a first support member 28 having a first end 30 fixed to the upper end 22 of the pole 12. The first support member 28 extends away from the plane defined by the net 16 and the poles 12 to a second end 32. A flange 34 can be provided between the pole 12 and a lower surface of the first support member 28 to ensure that the support member 28 remains perpendicular to the pole 12.

A second support member 36 includes an inner end 38 and an outer end 40. The second support member 36 can be fixed to a second end 32 of the first support member 28 by welding or the like. The second support member 36 is preferably perpendicular to the first support member 28 and preferably lies in a plane parallel to the playing surface 14. A third support member 42 preferably extends obliquely from a point on the second support member 36 adjacent the outer end 40 and spaced from the second end 32 of the first support member 28 to a point 44 on the pole 12 below the upper end 22 of the pole 12 and above the net 16. The third support member 42 resists any inward deflection of the poles 12 due to the tension on the net 16.

Figure 7:
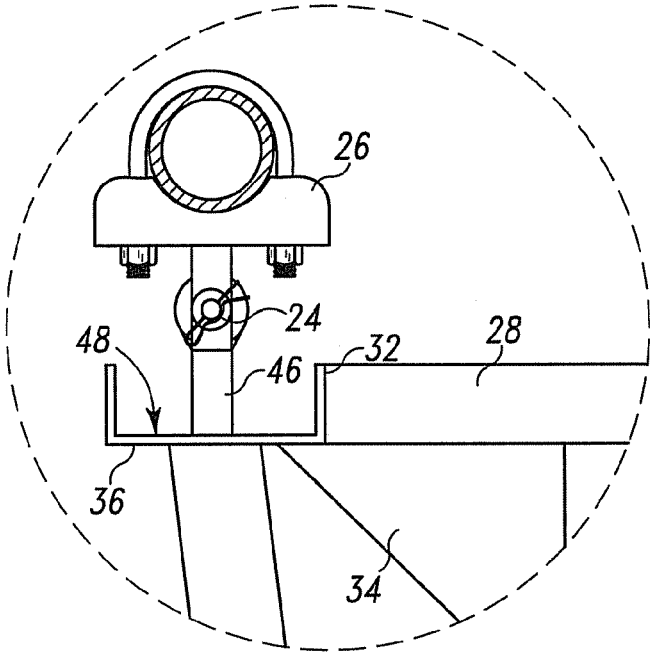
FIG. 7 is a side elevation detail view of the upper end of a single mast used in the net system of the present invention.

The pivot members 24 are preferably coupled to the second support member 36 adjacent to the ends 38, 40 of the second support member. The pivot members 24 are spaced from the plane containing the poles 12 and net 16 by the length of the first support member 28. The pivot members 24 can be on upward extensions 46 fixed to an upper surface 48 of the second support member 36 as shown in detail in FIG. 7. The coupling members 26 coupling the pivot members 24 to the ceiling structure can vary depending on the precise nature of the ceiling.

Figure 2B:
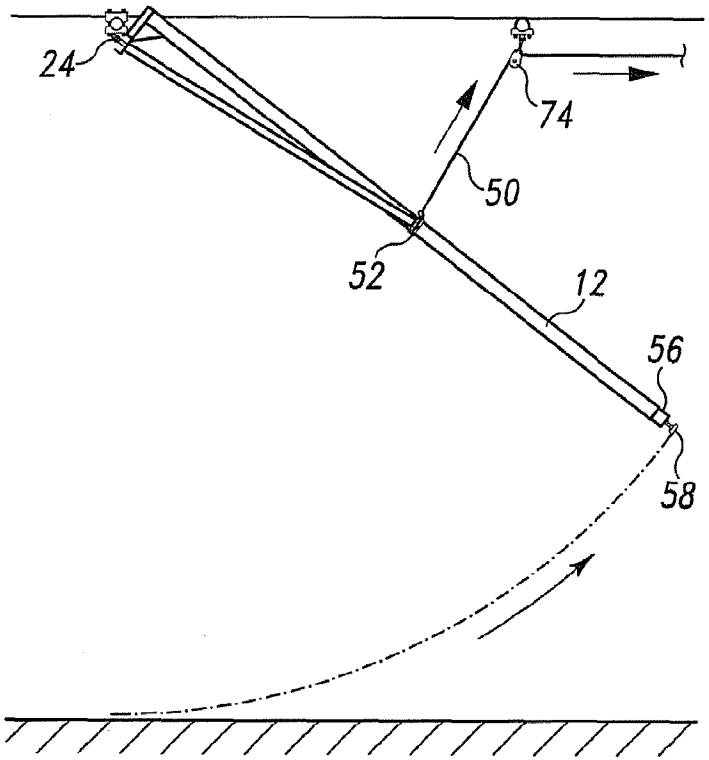
FIG. 2*b* is a side elevation similar to FIG. 2*a* showing the displacement of the net system toward the horizontal storage position.
Figure 2A:
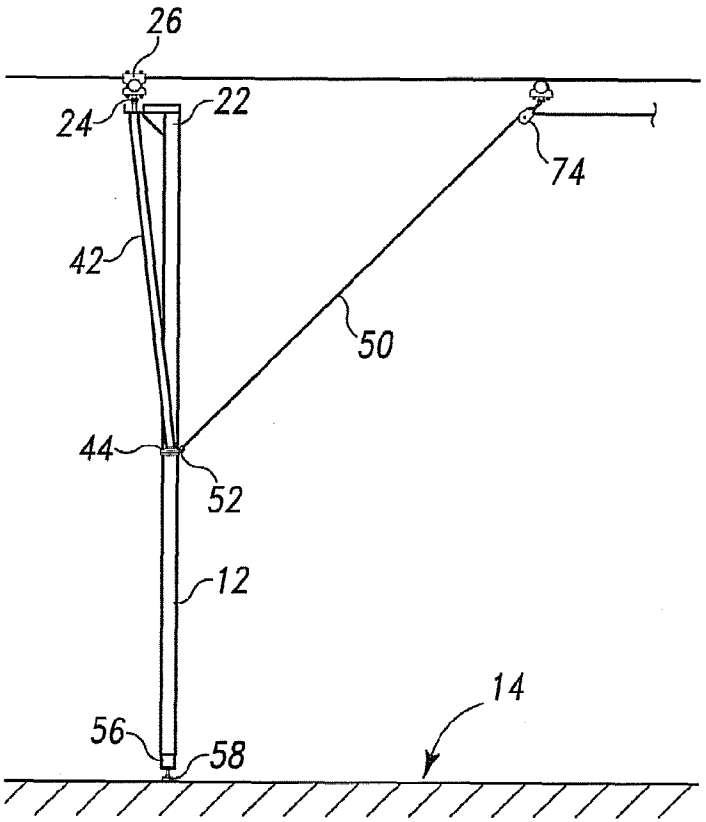
FIG. 2*a* is a side elevation of the net system as shown in FIG. 1.

The pivot members 24 allow the poles 12 and net 16 to be pivotally displaced from a vertical playing position in a vertical plane bifurcating the playing area as shown in FIG. 2*a* to a nearly horizontal non-playing storage position above a playing surface 14 on one side of the playing area as shown in FIG. 2*b*. The movement of the net 16 and poles 12 is achieved by a flexible tension member 50, which can be a rope, chain or cable, coupled to each pole 12. The flexible tension member 50 can be conveniently coupled at the junction 52 of the third support member 42 and pole 12. Each tension member has a second end 54 coupled to a driver 55, which can be a reel, winch or windlass, for moving the net 16 and poles 12 between the playing position and the storage position. The driver 55 can be controlled by conventional controls to permit a measured take-up or play-out of the flexible tension member 50 to pivotally raise and lower the poles 12 about the pivot members 24.

Figure 8:
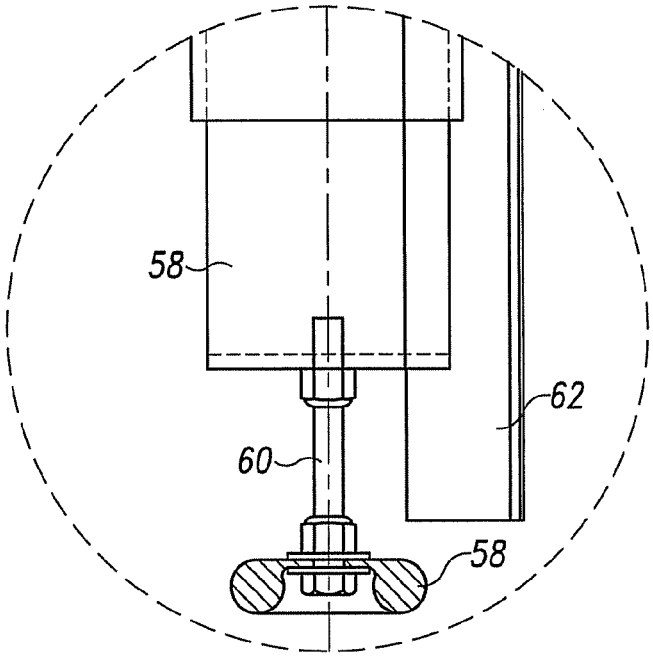
FIG. 8 is a front elevation detail of the lower end of a single mast used in the net system of the present invention.

The position of the pivot members 24 to one side of the plane containing the net 16 and poles 12 ensures a downward force on the playing surface 14 by lower ends 56 of the poles 12 when the poles are in the vertical playing position shown in FIGS. 1 and 2*a*. A cushion member 58 is preferably fixed to a lower end of a vertically adjustable member 60, which can be a threaded member, movably mounted to the lower end 56 of each of the poles 12 as shown in FIG. 8. The cushion member 58 protects the playing surface 14 from abrasion or other marking while the net is situated in the playing position. The playing position of the poles 12 and net 16 can be adjusted by suitable movement of the adjustable member 60 with respect to the lower ends 56 to achieve vertical alignment of the poles 12 when in the playing position.

Figure 6:
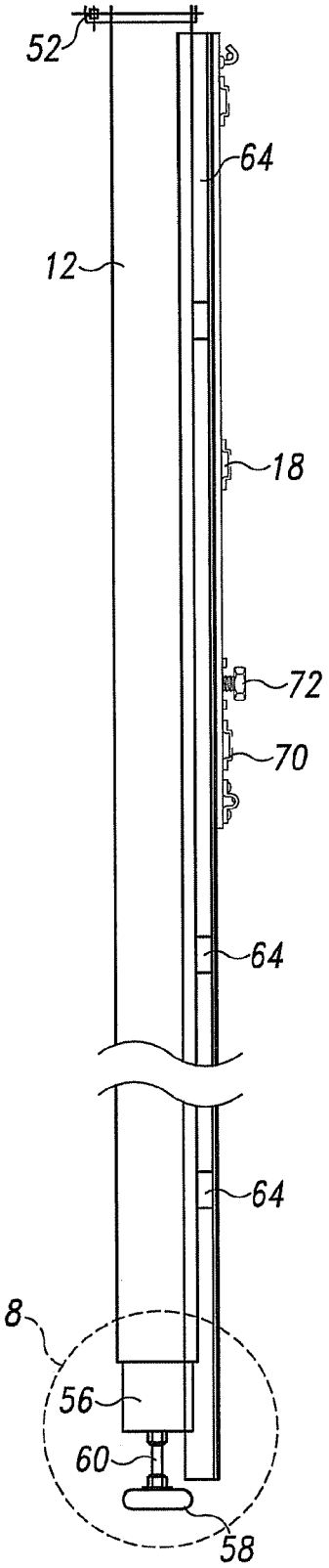
FIG. 6 is a front elevation of a lower portion of a single mast used in the net system of the present invention.
Figure 9:
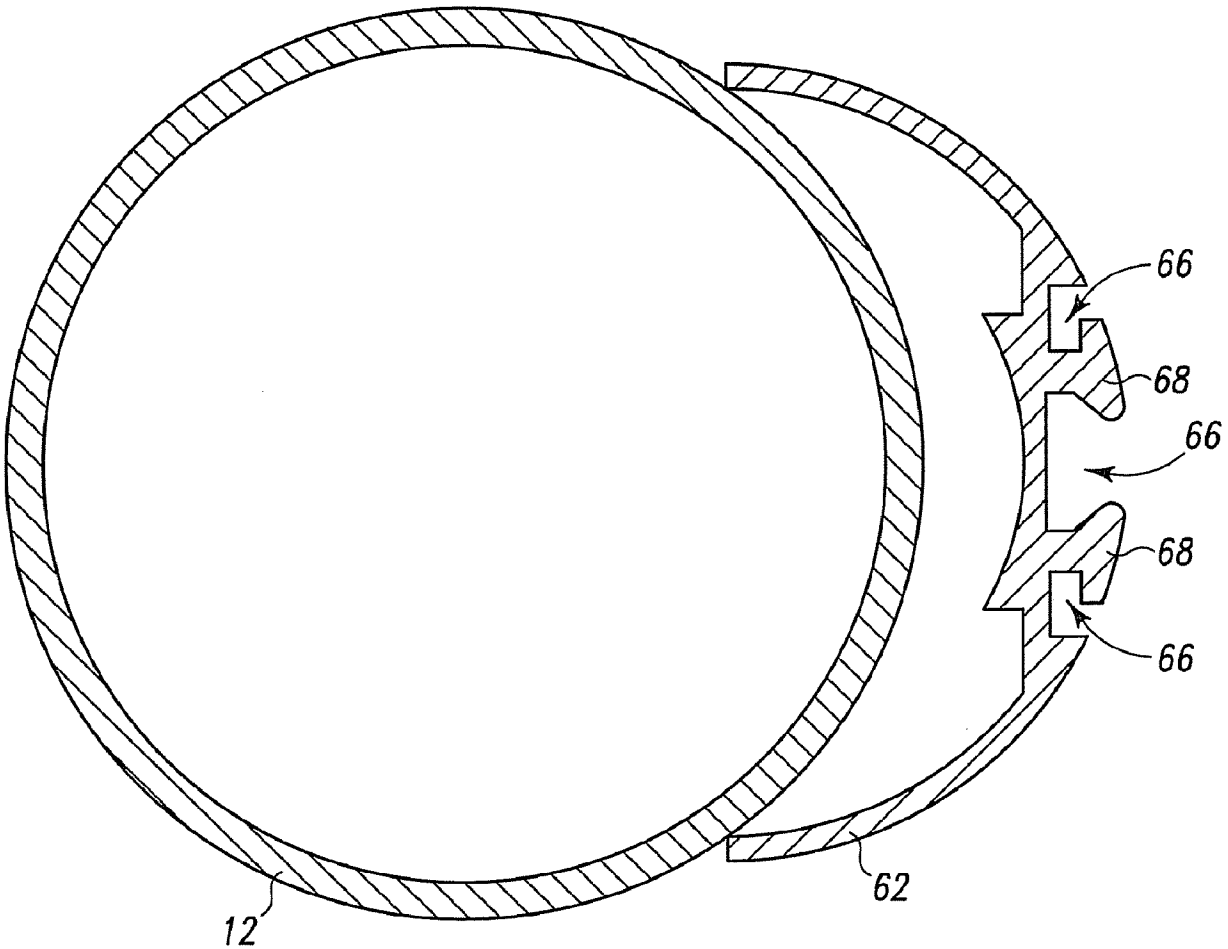
FIG. 9 is a sectional detail view of a single mast used in the net system of the present invention showing the vertically movable net carrier.

A net support track 62 is shown in vertical cross-section in FIG. 6 and in horizontal cross-section in FIG. 9. The net support track 62 is fixed to the poles 12 by suitable fasteners 64. The net support track 62 is configured to have a series of grooves 66 and projections 68 adapted to interact with a vertically movable net holding member 70 shown in FIG. 6. A clamp member 72 is provided to fix the net holding member 70 at any desired position with respect to the net support track 62 so that the net 16 can be situated at any selected position between a tennis position with the lower margin of the net 16 is adjacent to the playing surface upward to a men's volleyball position.

FIG. 2*b* shows the movement of the net system 10 of the present invention between the playing position shown in FIGS. 1 and 2*a* and the storage position, which can be at any convenient position above that shown in FIG. 2*b*. The flexible tension members 50 can be directed through pulleys 74 that are coupled as needed to convenient points over the playing surface 14. As the net system 10 is lowered from a storage position to the playing position the driver 55 is permitted to play-out the flexible tension members 50 at a rate that will cause a controlled pivotal descent of the poles 12. As the poles 12 approach a vertical position, the position of the cushion members 58 can be adjusted to prevent the poles 12 from swinging past the vertical position. A further play-out of the flexible tension members 50 to an essentially relaxed posture assures that the weight of the net system 10 will maintain the poles 12 at a fixed position with respect to the playing area 14. That is, no guy wires, clips or floor openings are needed to maintain the net system 10 fixed at the playing position. The net 16 can then be vertically adjusted to accommodate the particular standards of the selected sport. When it becomes desirable to change from one net sport to another, the vertical position of the net 16 can easily be modified without movement of the poles 12. When it becomes desirable to clear the playing area 14 entirely, the net system 10 can be quickly moved from the playing position to a storage position by merely actuating the driver 55 to reel in the flexible tension members 50, which will cause the net system 10 to undergo the movement illustrated in FIG. 2*b*.

While these features have been disclosed in connection with the illustrated preferred embodiment, other embodiments of the invention will be apparent to those skilled in the art that come within the spirit of the invention as defined in the following claims.

What is claimed is:

1. A net system for positioning a net in a playing area, the net system comprising: a pair of parallel poles vertically positionable on opposite sides of the playing area, a net coupled to the pair of poles to lie in a plane including the pair of poles, supports fixed to an upper end of each of the pair of poles including pivot members positioned on one side of the plane, coupling members for coupling the pivot members to ceiling structure covering the playing area, the pivot members allowing the poles and net to be pivotally displaced from a substantially horizontal storage position above a playing surface on one side of the playing area to a vertical playing position in a vertical plane bifurcating the playing area, the position of the pivot members ensuring a downward force on the playing surface by lower ends of the poles when the poles are in the vertical playing position.

2. The net system of claim 1 further comprising net support members coupled to each of the poles and to the net, the net support members being movable with respect to the poles so that the net can be situated at any selected position between a tennis position with the lower margin of the net adjacent to the playing surface upward to a men's volleyball position.

3. The net system of claim 1 wherein each of the supports fixed to the upper end of each of the pair of poles comprise a first member extending perpendicular to said plane, a second member fixed perpendicular to the first member in a plane parallel to the playing surface, and a third member extending obliquely from a point on the second member spaced from the first member to a point on the pole below the upper end of the pole and above the net.

4. The net system of claim 3 further comprising a tension member coupled to each pole at the junction of the third member and pole, each tension member having a second end coupled to a driver for moving the net and poles between the playing position and the storage position.

5. The net system of claim 3 wherein said pivot members are coupled to the second member adjacent opposite ends of the second member, and include upward extensions fixed to the second member.

6. The net system of claim 1 further comprising a cushion member movably mounted to the bottom of each of the poles to adjust the vertical alignment of the poles when in the playing position.

7. A net system for pivotally displacing a net between a playing position in a vertical plane bifurcating a playing area and a substantially horizontal elevated storage position freeing the playing area for other uses, the net system comprising: a pair of parallel poles located on opposite sides of the playing area, a net coupled to the pair of poles to lie in a plane including the pair of poles, coupling members for coupling pivot members to ceiling structure above the playing area, and supports having a proximal end fixed to an upper end of each of the pair of poles and a distal end extending on a common side of the plane, the distal end of the supports being coupled to the pivot members to allow the poles and net to be pivoted about an axis lying parallel to but outside said plane, the position of the pivot members ensuring a downward force on the playing surface by lower ends of the poles when the poles are in the vertical playing position.

8. The net system of claim 7 wherein each of the supports fixed to the upper end of each if the pair of poles comprise a first member extending perpendicular to said plane, a second member fixed perpendicular to the first member in a plane parallel to the playing surface, and a third member extending obliquely from a point on the second member spaced from the first member to a point on the pole between the upper end of the pole and the net.

9. The net system of claim 8 wherein said pivot members are coupled to the second member adjacent opposite ends of the second member, and include upward extensions fixed to the second member.

10. The net system of claim 9 further comprising a tension member coupled to each pole at the junction of the third member and pole, each tension member having a second end coupled to a winch for moving the net and poles between the playing position and the storage position.

11. The net system of claim 10 further comprising a cushion member movably mounted to the bottom of each of the poles to adjust the vertical alignment of the poles when in the playing position.

12. The net system of claim 11 further comprising net support members coupled to each of the poles and to the net, the net support members being movable with respect to the poles so that the net can be situated at any selected position between a tennis position with the lower margin of the net adjacent to the playing surface upward to a men's volleyball position.

13. A net system for pivotally displacing a net between a playing position in a vertical plane bifurcating a playing area and a substantially horizontal elevated storage position freeing the playing area for other uses, the net system comprising: a pair of parallel poles located on opposite sides of the playing area, a net coupled to the pair of poles to lie in a plane including the pair of poles, coupling members for coupling pivot members to ceiling structure above the playing area, supports having a proximal end fixed to an upper end of each of the pair of poles and a distal end extending on a common side of the plane, the distal end of the supports being coupled to the pivot members to allow the poles and net to be pivoted about an axis lying parallel to but outside said plane, the position of the pivot members ensuring a downward force on the playing surface by lower ends of the poles when the poles are in the vertical playing position, and a cushion member movably mounted to the bottom of each of the poles to adjust the vertical alignment of the poles to achieve the optimal playing position.

14. The net system of claim 13 further comprising net support members coupled to each of the poles and to the net, the net support members being movable with respect to the poles so that, when the poles are in the playing position, the net can be situated at any selected position between a tennis position with the lower margin of the net adjacent to the playing surface upward to a men's volleyball position.

15. The net system of claim 14 wherein said pivot members are coupled to the second member adjacent opposite ends of the second member, and include upward extensions fixed to the second member.

16. The net system of claim 13 wherein each of the supports fixed to the upper end of each if the pair of poles comprise a first member extending perpendicular to said plane, a second member fixed perpendicular to the first member in a plane parallel to the playing surface, and a third member extending obliquely from a point on the second member spaced from the first member to a point on the pole between the upper end of the pole and the net.

17. The net system of claim 16 further comprising a tension member coupled to each pole at the junction of the third member and pole, each tension member having a second end coupled to a winch for moving the net and poles between the playing position and the storage position.

18. A method for deploying a net to a playing position in a vertical plane bifurcating a playing area, the method comprising the steps of:

providing a pair of parallel poles vertically positionable on opposite sides of the playing area having a net coupled to the pair of poles to lie in a plane including the pair of poles with supports fixed to an upper end of each of the pair of poles including pivot members positioned on one side of the plane, coupling the pivot members at selected points of a ceiling structure covering the playing area to allow the poles and net to be pivotally displaced from a storage position above a playing surface on one side of the playing area to a vertical playing position in a vertical plane bifurcating the playing area, and adjusting the position of members on the lower end of each of the pair of poles to ensuring a downward force on the playing surface by the lower ends of the poles when the poles are in the vertical playing position.

19. The method of claim 18 further comprising the step of adjusting the position the net relative to the pair of parallel poles to accommodate the particular standards of a selected sport.

20. The method of claim 18 further comprising the step of controlling the rate of pivotal descent of the pair of parallel poles by a controlled play-out of a flexible tension line coupled between the poles and a driver.

* * * * *